US011346135B1

(12) United States Patent
King

(10) Patent No.: US 11,346,135 B1
(45) Date of Patent: May 31, 2022

(54) COVER ASSEMBLY FOR LOCK ASSEMBLY OF A SHIPPING CONTAINER

(71) Applicant: Steven King, Frankfort, IL (US)

(72) Inventor: Steven King, Frankfort, IL (US)

( * ) Notice: Subject to any disclaimer, the term of this patent is extended or adjusted under 35 U.S.C. 154(b) by 459 days.

(21) Appl. No.: 16/384,408

(22) Filed: Apr. 15, 2019

(51) Int. Cl.
*E05B 67/38* (2006.01)
*E05B 83/10* (2014.01)

(52) U.S. Cl.
CPC ..... *E05B 67/38* (2013.01); *E05B 83/10* (2013.01)

(58) Field of Classification Search
CPC ..... E05B 67/38; E05B 83/10
USPC ..... 70/54–56, 417, 202, 211; 292/205, 292/DIG. 32
See application file for complete search history.

(56) References Cited

U.S. PATENT DOCUMENTS 547,550 A * 10/1895 Hopkins ..... E05B 67/38 70/56
4,555,920 A * 12/1985 Stanich ..... E05B 67/38 70/54
5,118,149 A * 6/1992 Emmons ..... E05B 13/002 292/205
5,168,258 A * 12/1992 Radke ..... E05B 67/38 340/542
5,477,710 A * 12/1995 Stefanutti ..... E05B 67/38 70/417
5,743,118 A * 4/1998 Anderson ..... E05B 13/002 292/205
5,875,659 A * 3/1999 Nosse ..... E05B 17/002 70/56

(Continued)

FOREIGN PATENT DOCUMENTS

EP 2060709 8/2002
GB 2293621 4/1998
JP 2002097830 4/2002

*Primary Examiner* — Suzanne L Barrett
(74) *Attorney, Agent, or Firm* — Schacht Law Office, Inc.; Paul J. Nykaza

(57) ABSTRACT

A tamper resistant cover assembly for a lock assembly operably connected to a shipping container is disclosed. The lock assembly has a closed configuration when a door of the shipping container is in a shut configuration. The tamper resistant cover assembly has a cover housing defining an interior chamber and a bottom opening in communication with the interior chamber. A slot is defined in the housing and being in communication with the interior chamber, the slot dimensioned to be configured to receive the lock assembly of the shipping container. A projection arm has a proximal end and distal end. The proximal end is connected to an inner surface of the cover housing wherein the projection arm extends into the interior chamber. The projection arm has an aperture therein. When the lock assembly of the shipping container is in the closed configuration, the cover assembly is positioned on the shipping container wherein the slot is configured to receive the lock assembly. The projection arm is positioned proximate the lock assembly wherein the aperture is generally aligned with openings in the lock assembly. The bottom opening is configured to receive a padlock wherein a shackle of the padlock is configured to be inserted through the projection arm aperture, the shackle configured to be inserted into the openings of the lock assembly wherein the padlock is configured to be locked to place the lock assembly in a locked configuration, wherein the cover assembly is configured to provide a tamper-resistant configuration for the lock assembly.

21 Claims, 11 Drawing Sheets

(56) References Cited

U.S. PATENT DOCUMENTS 5,878,604 A * 3/1999 Stone ..... E05B 67/38 70/56
5,975,595 A * 11/1999 Lorenzo ..... E05B 67/38 292/205
6,058,745 A * 5/2000 Sanchez ..... E05B 67/38 70/417
6,233,984 B1 * 5/2001 Blehi, III ..... E05B 13/002 70/2
6,357,266 B1 * 3/2002 Van Buren ..... E05B 83/10 70/211
6,519,982 B1 * 2/2003 Brammall ..... E05B 67/38 292/205
6,581,419 B1 6/2003 Strodtman
6,622,533 B1 * 9/2003 Santini ..... E05B 13/002 292/282
6,846,024 B1 * 1/2005 Palzkill ..... E05B 39/00 292/261
7,201,028 B1 * 4/2007 Gogel ..... E05B 67/38 292/205
7,210,316 B1 * 5/2007 Falconer ..... E05B 13/002 292/218
7,278,284 B1 10/2007 James
7,278,603 B2 10/2007 Witchey
7,412,856 B1 * 8/2008 Gogel ..... E05B 13/002 292/218
7,891,219 B1 * 2/2011 Gogel ..... E05B 67/38 70/56
8,011,213 B1 * 9/2011 Gogel ..... E05B 63/042 70/56
8,438,884 B1 * 5/2013 Bertrand ..... E05B 67/38 70/54
9,032,765 B2 * 5/2015 Boesel ..... E05B 67/383 70/56
9,562,374 B1 * 2/2017 Haber ..... E05B 83/14
10,107,008 B2 * 10/2018 Waugh ..... E05B 13/002
10,954,699 B2 * 3/2021 Pare ..... E05B 83/10
2008/0216524 A1 * 9/2008 Abdelazeem ..... E05B 67/38 70/13
2009/0217713 A1 * 9/2009 Loughlin ..... E05B 67/36 70/53

* cited by examiner

COVER ASSEMBLY FOR LOCK ASSEMBLY OF A SHIPPING CONTAINER

CROSS-REFERENCE TO RELATED APPLICATIONS

None.

FEDERALLY SPONSORED RESEARCH OR DEVELOPMENT

None.

TECHNICAL FIELD

The invention relates generally to a cover assembly for a lock assembly on a shipping container and, in particular, a cover assembly that is capable of being removably attached to the shipping container that reduces the ability for bad actors to tamper with a padlock on the shipping container to gain unauthorized access to the shipping container.

BACKGROUND OF THE INVENTION

Large shipping containers are known in the art and used for the storage and transport of various goods in large quantities. The shipping containers are typically loaded with goods and the containers are placed in mass on large ships. Once a ship reaches its destination, the shipping containers are transported via gantry cranes off the ship and eventually, for example, on railcars or semi-tractor trailers. Shipping containers can also be used in various work yards to store inventories or supplies. Shipping containers can further be used in various other applications requiring the secure storage of equipment, goods, supplies or other items.

Because the shipping containers store valuable goods, the containers are subject to break-ins by bad actors such as burglars for the purpose of theft or vandalization of the contents. The shipping containers are equipped with lock assemblies to secure the contents of the containers. As is known, the shipping container defines a compartment for receiving the goods etc. to be stored and transported. The shipping container has a door having a closed or shut configuration and an open configuration to allow access to the compartment. The shipping container further has the lock assembly, wherein the lock assembly has a lock bolt moveably/pivotably mounted on the door and having a lock handle connected to the lock bolt. The lock bolt has a distal end defining a locking element that is received in a keeper or cavity of the shipping container when the door is in the closed configuration. The lock bolt is removed from the keeper or cavity to allow the door to be positioned in the open configuration. The lock assembly further has a first clasp member having a first clasp opening mounted on the door and a second clasp member having a second clasp opening mounted on the door. The lock handle is positionable between the clasp members. In this position, a padlock having a shackle can be inserted through apertures on the clasps to lock the shipping container wherein the shipping container is in a locked configuration. It is understood that the shipping container may have a pair of doors, with each door having a lock assembly.

Without any external protections, the padlock is exposed to an outside atmosphere where one can gain easy and open access to the padlock. This allows would-be intruders, burglars and thieves to break the lock of the shipping container with various forms of diabolical tools of intrusion such as bolt cutters, hack saws and the like. Consequently, the bad actors can steal or otherwise vandalize the contents of the containers. In some designs, additional protective members may be welded or secured around the lock assembly area in the proximity of the padlock. These structures are often cumbersome and still do not provide sufficient protection to the padlock. Such structures are also required to be permanently installed on every shipping container in order to have protection of the padlock.

While such protective members according to the prior art provide a number of advantageous features, they nevertheless have certain limitations. The present invention is provided to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention provides a cover assembly for a lock assembly on a shipping container. The cover assembly can be removably attached to the shipping container. The cover assembly reduces the ability for bad actors to tamper with a padlock on the shipping container. It is understood that the cover assembly can be used with various types of containers and lock assemblies.

According to a first aspect of the invention, a tamper resistant cover assembly is operably connected to a shipping container. The lock assembly has a closed configuration when a door of the shipping container is in a shut configuration. The tamper resistant cover assembly has a cover housing defining an interior chamber and a bottom opening in communication with the interior chamber. A slot is defined in the housing and being in communication with the interior chamber, the slot dimensioned to be configured to receive the lock assembly of the shipping container. A projection arm has a proximal end and distal end. The proximal end is connected to an inner surface of the cover housing wherein the projection arm extends into the interior chamber. The projection arm has an aperture therein. When the lock assembly of the shipping container is in the closed configuration, the cover assembly is positioned on the shipping container wherein the slot is configured to receive the lock assembly. The projection arm is positioned proximate the lock assembly wherein the aperture is generally aligned with openings in the lock assembly. The bottom opening is configured to receive a padlock wherein a shackle of the padlock is configured to be inserted through the projection arm aperture, the shackle configured to be inserted into the openings of the lock assembly wherein the padlock is configured to be locked to place the lock assembly in a locked configuration, wherein the cover assembly is configured to provide a tamper-resistant configuration for the lock assembly.

According to another aspect of the invention, the cover housing has a front wall and a rear wall connected together by a first side wall and a second side wall, the housing further having a top wall connected to the front wall, rear wall, first side wall and second side wall to cooperatively define the interior chamber.

According to another aspect of the invention, the projection arm extends from one of the first sidewall and the second side wall. The projection arm is positioned between the front wall and the rear wall.

According to another aspect of the invention, the slot comprises a first slot defined in the front wall and being in communication with the interior chamber, the first slot having a generally vertical configuration, and a second slot defined in the front wall and in a portion of the first sidewall and in a portion of the second sidewall, the second slot being in communication with the interior chamber, the second slot having a generally horizontal configuration and intersects the first slot.

According to a further aspect of the invention, a portion of one of the first side wall and the second side wall proximate the second slot defines a lip, wherein when the cover assembly is positioned on the shipping container wherein the lock assembly is received by the first slot and the second slot, the lip is configured to engage a lock handle of the lock assembly.

According to a further aspect of the invention, the top wall and the rear wall are solid, uninterrupted structures having no openings. The front wall, the first side wall and the second side wall are formed from an integral structure.

According to a further aspect of the invention, the cover assembly is formed from a metal material. The cover assembly could also be formed from one of a metal material, metal alloy material, fiber reinforced plastic material, ceramic material or composite material.

According a further aspect of the invention, a handle is connected to a rear wall of the cover housing.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION OF THE PREFERRED EMBODIMENT

Figure 1:
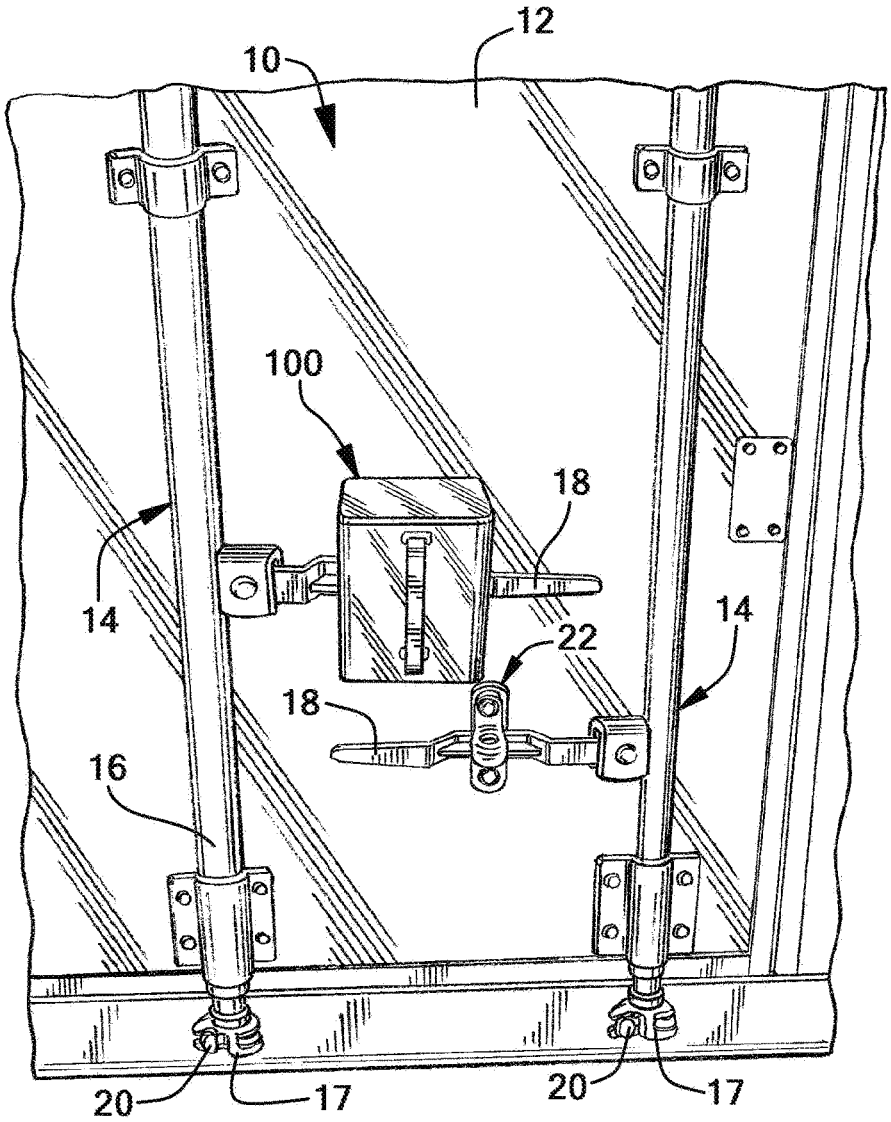
FIG. 1 is a perspective view of a traditional shipping container having a door with lock assemblies mounted thereon, one of the lock assemblies having a cover assembly mounted thereon according to an exemplary embodiment of the present invention.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the drawings, FIG. 1 discloses a perspective view of a cover assembly for a lock assembly on a shipping container according to an exemplary embodiment of the present invention, generally designated with the reference numeral 100. As described in greater detail herein, the cover assembly 100 is capable of being removably attached to a shipping container to reduce the ability for a bad actor to break the lock assembly to gain unauthorized access to the contents of the shipping container. In one exemplary embodiment, the cover assembly 100 is used with a shipping container, but it is understood that the cover assembly 100 can be used with other types of containers or other types of lock assemblies.

Figure 2:
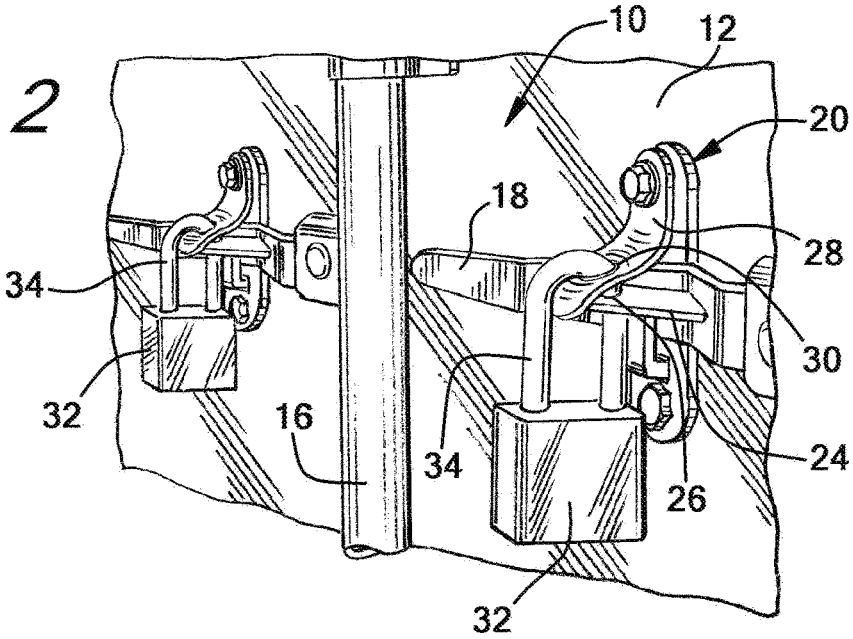
FIG. 2 is partial perspective view of lock assemblies of a shipping container and having padlocks having respective shackles positioned through clasp members of the lock assemblies in a locked configuration.

FIGS. 1 and 2 show a conventional shipping container, generally designated with the reference numeral 10. It is understood that the shipping container 10 has a plurality of walls and a door defining a chamber therein to store goods, equipment, items etc. The container 10 has a door 12, and in certain embodiments a pair of doors 12 may be utilized. The door 12 typically includes a lock assembly 14 operably associated therewith to control access into the shipping container 10. The lock assembly 14 may generally include, among other components, a mechanical lock bolt 16, a lock handle 18, a lock bolt receiver 20 or keeper 20 and clasp assembly 22. The keeper 20 in certain embodiments could be a cavity that receives the lock bolt 106. A distal end of the lock bolt 16 may be considered to form a locking element 17. The clasp assembly 22 includes a first clasp member 24 having a first clasp opening 26. The clasp assembly 22 also includes a second class member 28 having a second clasp opening 30. The mechanical lock bolt 16 is an elongated member that is movably mounted on the door 102. The lock handle 18 is connected to the mechanical lock bolt 16. The keeper 20 is incorporated onto or into the shipping container 10. The clasp assembly 22 is mounted on the door 12 wherein the first clasp member 24 is mounted adjacent to the second clasp member 28 and in spaced relation to receive the lock handle 18. When the lock assembly 14 is in a closed configuration, a distal end of the mechanical bolt 16 is received in the keeper 20 or otherwise engaged with the keeper 20. The clasp members 24, 28 are positioned around the lock handle 18 such that the first clasp opening 26 is generally aligned with the second clasp opening 30. The openings 26, 30 are dimensioned to receive a padlock 32 to lock the lock assembly 14 in the closed configuration. The lock 32 could also take other forms of locks. The padlock 32 has a shackle 34 that is inserted into the clasp openings 26, 30. In an unlocked configuration, the padlock 32 is removed, one of the clasp members is pivoted wherein the lock handle 18 can move the lock bolt 16 out of the keeper 20. The door 12 of the container 10 can then be opened to gain access into the shipping container 10.

As explained in greater detail herein, the cover assembly 100 is used with the lock assembly 14 on the shipping container 10. As further shown in FIGS. 3-9, the cover assembly 100 generally includes a cover housing 102 and a projection arm 104. In an exemplary embodiment, the projection arm 104 may be integral with the housing 102 or separately attached or secured to the housing 102. Further, the projection arm 104 may be permanently attached to the housing 102. As further described below, the cover assembly 100 is dimensioned to be placed over the lock assembly 14 of the shipping container 10.

The cover housing 102 has a front wall 106 and a rear wall 108 connected together by a first side wall 110 and a second side wall 112. The cover housing 102 further has a top wall 114. The walls of the cover housing 102 cooperate to define an interior chamber 116. A bottom area of the cover housing 12 defines an opening 118 that is in communication with the interior chamber 116. It is understood that a bottom wall could be formed as part of the housing 102 that would include the opening 118 dimensioned to provide the necessary access as described in greater detail below. The walls 106, 108, 110, 112, 114 have generally planar surfaces. The rear wall 108 and the top wall 114 are planar, uninterrupted surfaces void of any holes, apertures or openings. For example, as can be appreciated from FIGS. 3, 7 and 9, the rear wall 108 and top wall 114 are solid walls providing no access to the interior chamber 116. Thus, as explained in greater detail below, one could not gain access to the projection arm 104 or padlock 32 from the rear wall 108 or the top wall 114.

Figure 3:
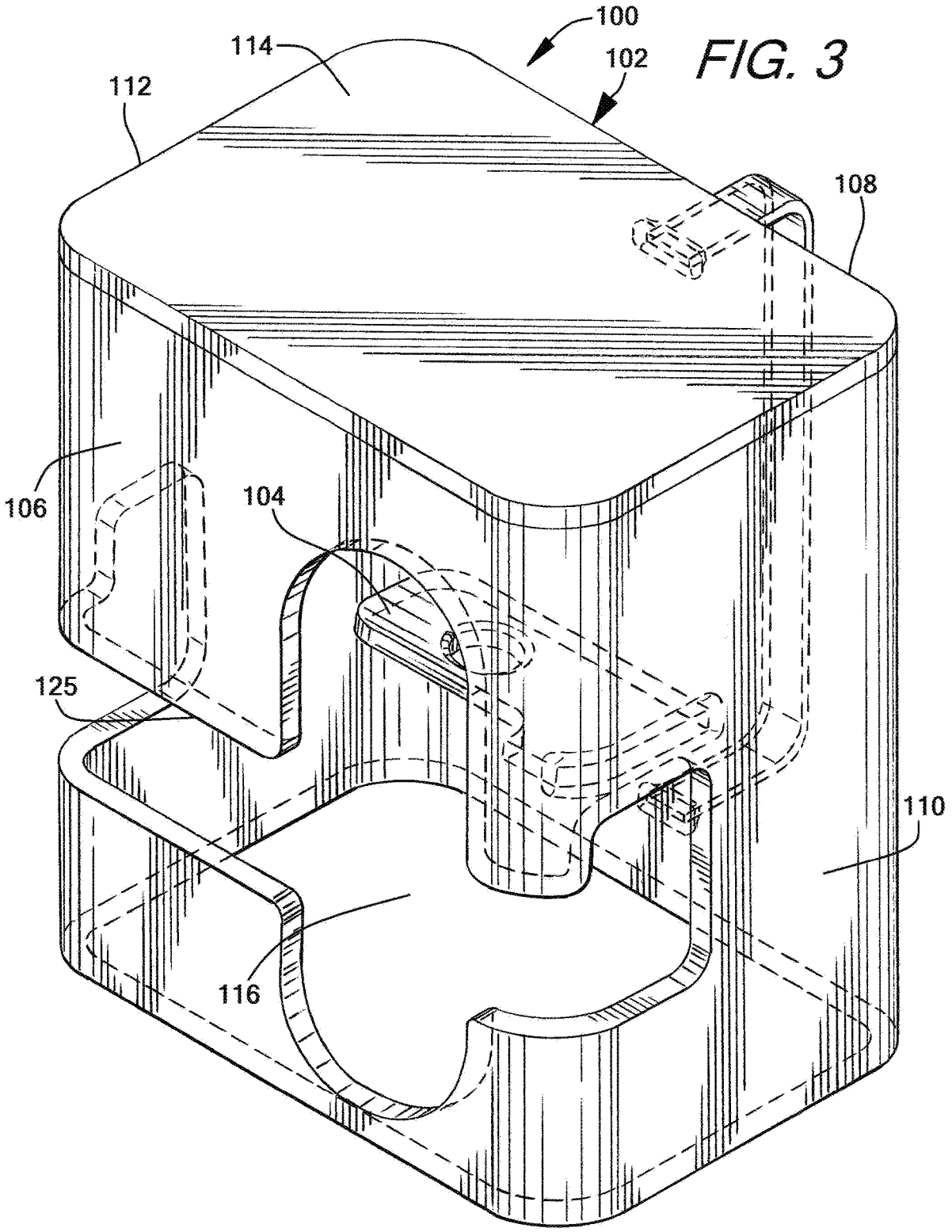
FIG. 3 is a front perspective view of the cover assembly according to an exemplary embodiment of the present invention.
Figure 5:
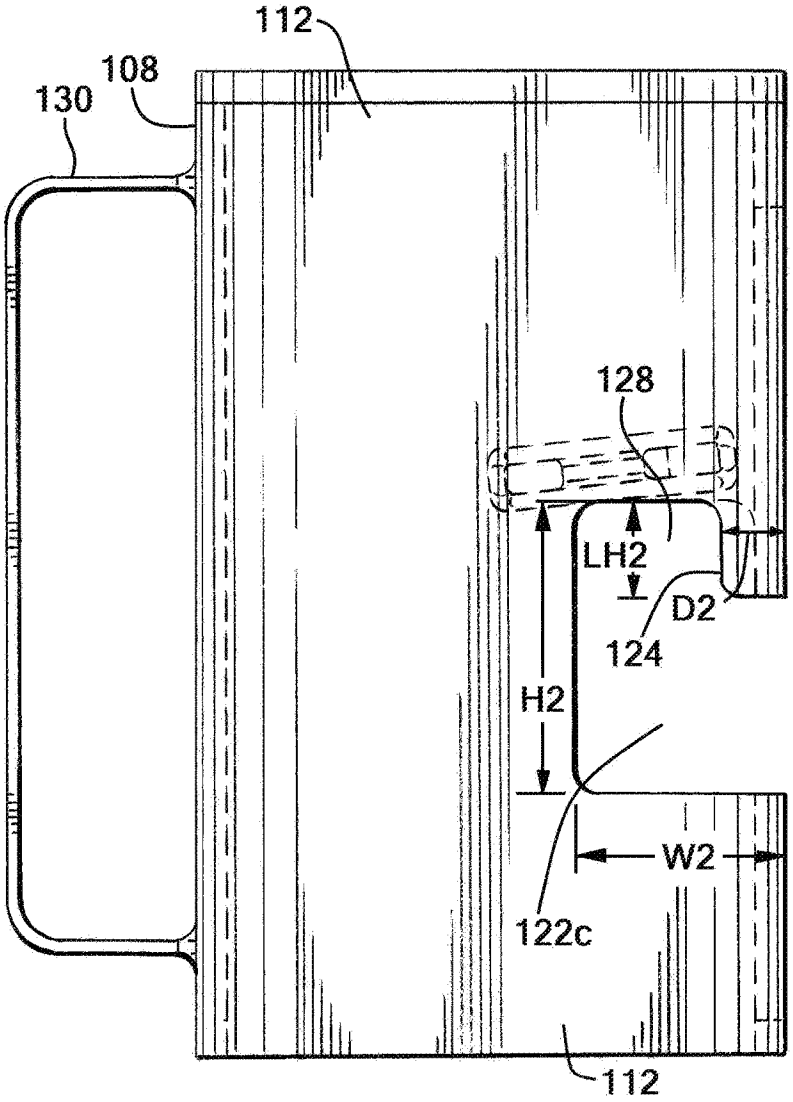
FIG. 5 is an opposite side elevation view of the cover assembly of FIG. 3.
Figure 4:
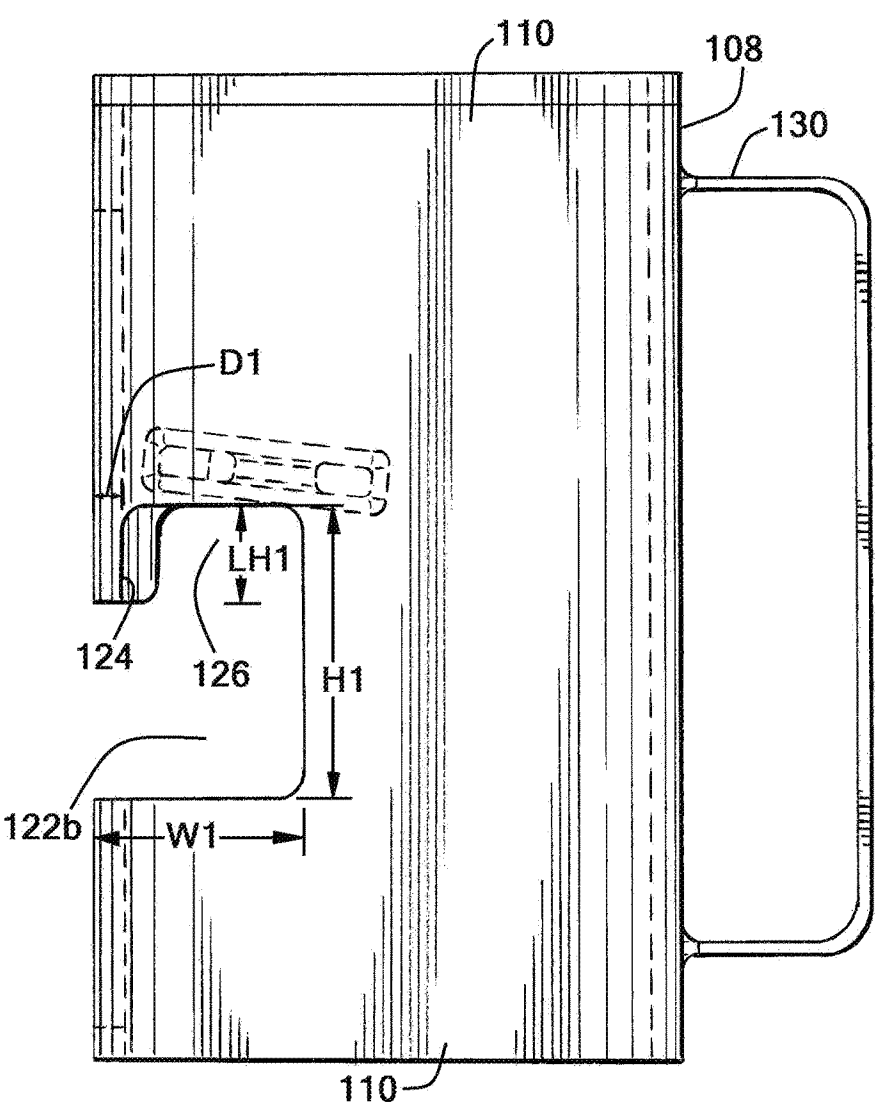
FIG. 4 is a side elevation view of the cover assembly of FIG. 3.
Figure 6:
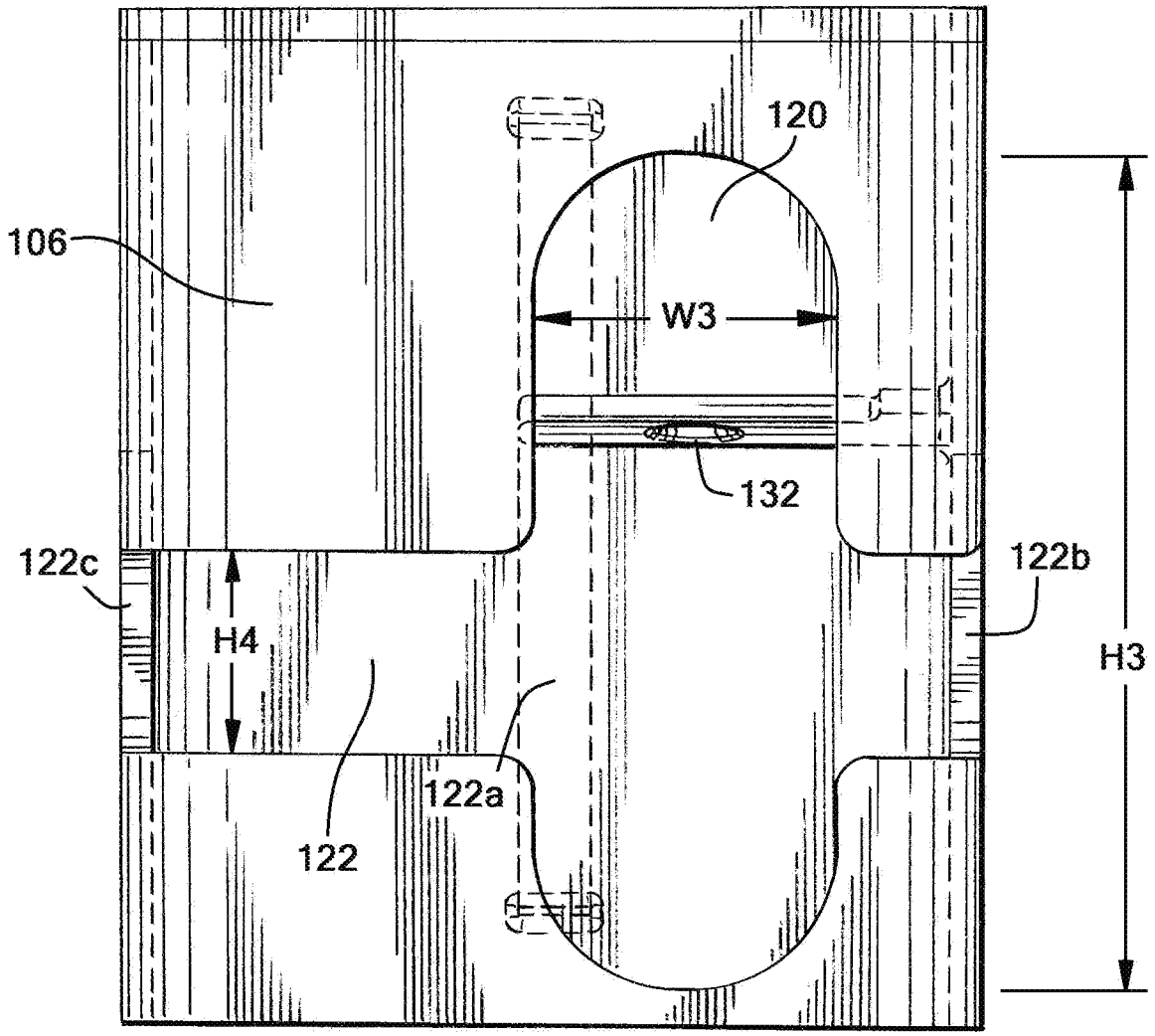
FIG. 6 is a front elevation view of the cover assembly of FIG. 3.
Figure 7:
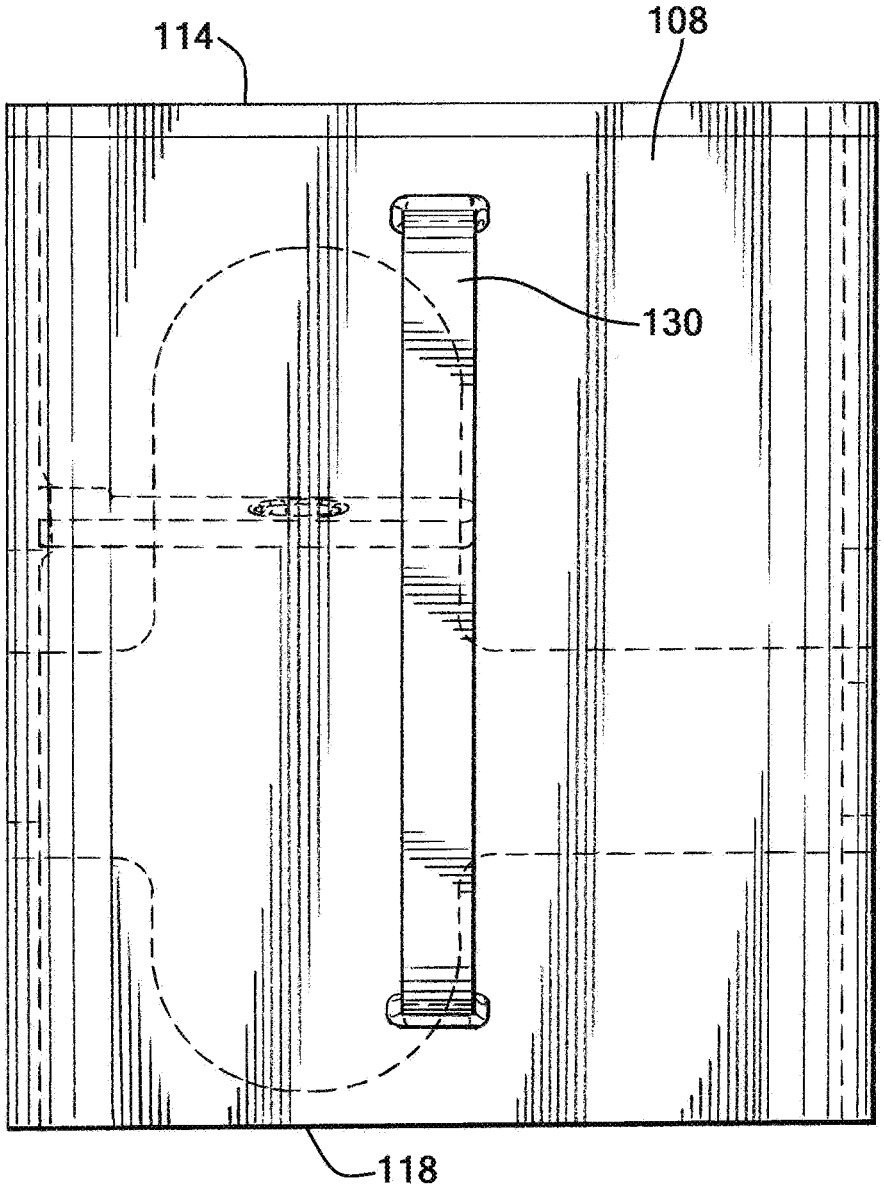
FIG. 7 is a rear elevation view of the cover assembly of FIG. 3.
Figure 8:
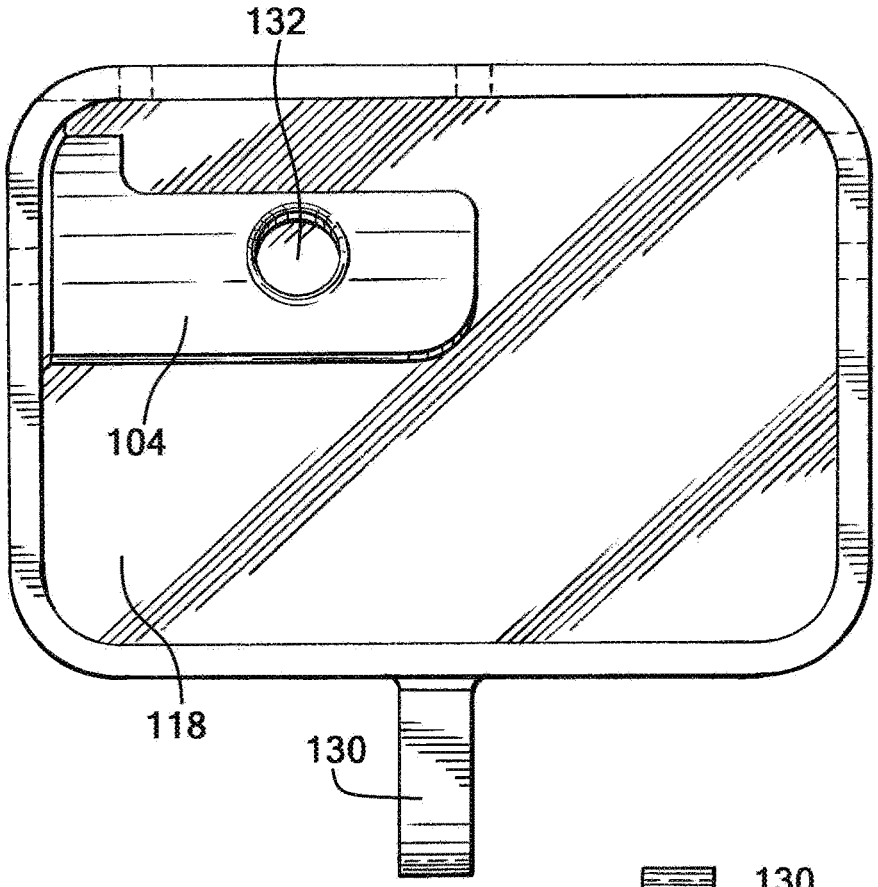
FIG. 8 is a bottom plan view of the cover assembly of FIG. 3.
Figure 9:
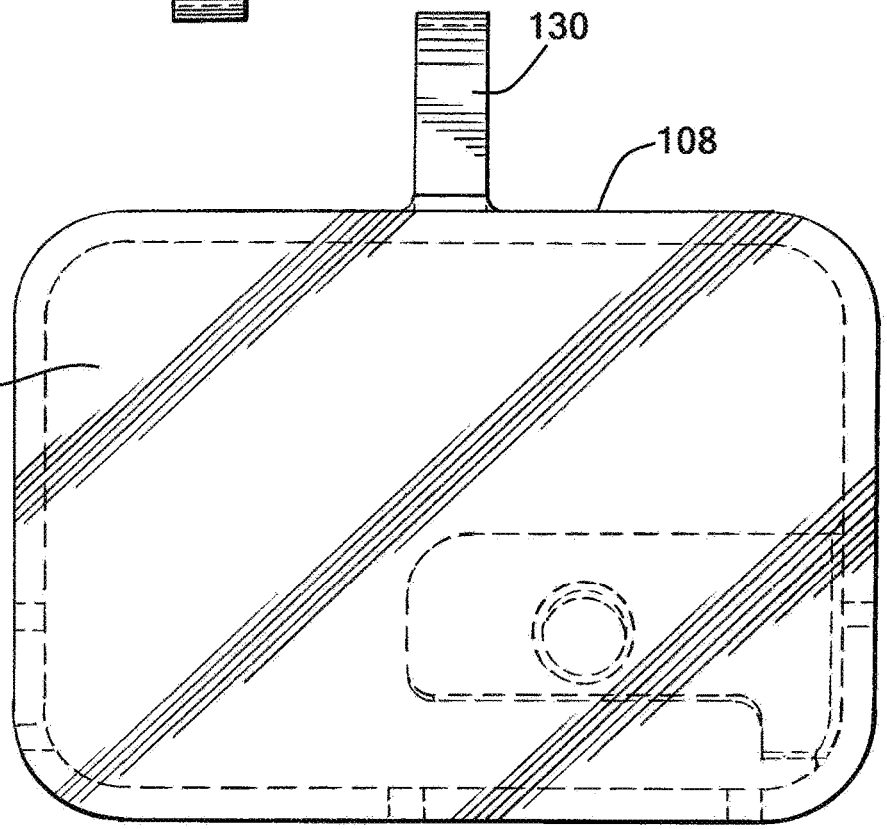
FIG. 9 is a top plan view of the cover assembly of FIG. 3.

As shown in FIGS. 3 and 6, the front wall 106 of the housing 102 has a first slot 120 therethrough positioned in a general vertical configuration. The first slot 120 extends in a general longitudinal direction between the top wall 114 and the bottom opening 118. The first slot 120 extends through the front wall 106 and is in communication with the interior chamber 116. As further can be appreciated from FIGS. 3 and 6, the first slot 120 extends in a longitudinal direction or vertical direction wherein the first slot 120 has a greater dimension in the longitudinal direction from the top wall 114 and the bottom opening 118 than the lateral dimension of the first slot 120 extending in a lateral direction between the first side wall 110 and the second side wall 112. The front wall 106 also has a second slot 122 that is positioned in a generally horizontal configuration. It is further understood that the first slot 120 has a rounded top end and a rounded bottom end. The second slot 122 extends generally between the first side wall 110 and the second side wall 112. The second slot 122 extends through the front wall 106 and is in communication with the interior chamber 116. The second slot 122 intersects with the first slot 120. As discussed, the second slot 122 is positioned through the front wall 14 and extends across an entire dimension of the front wall 106. As also shown in FIGS. 4-6, one end of the second slot 122 extends into the first side wall 110 and an opposite end of the second slot 122 extends into the second side wall 112. Thus, the second slot 122 has a central segment **122*a* and a first end segment 122*b* and a second end segment 122*c* that extends cooperatively from the first sidewall 110 across the front wall 106 and into the second sidewall 112. The central segment 122*a* extends across the entire front wall 106. It is understood that the end segments 122*b*, 122*c* extend into a portion of the respective side walls 110, 112. Thus, the first end segment 122*b* extends into a portion of the first side wall 110 and the second end segment 122*c* extends into a portion of the second side wall 112. As further shown in FIGS. 4 and 5, the first end segment 122*b* has a first upper offset portion 126 that is spaced inward in the first side wall 110 a distance D1 from the front wall 106. The second end segment 122*c* has a second upper offset portion 128 that is spaced inward in the second side wall 112 a distance D2 from the front wall 106. As further shown in FIGS. 4-5, 11 and 13-14, a portion of the first side wall 110 and the second side wall 112 define a lip 124 where the respective first and second end segments 122*b*, 122*c* are positioned in the first side wall 110 and the second side wall 112. The lip 124** will engage the lock handle when mounted on the shipping container as will be described in greater detail below.

The first slot 120 and the second slot 122 are dimensioned to fit closely over a lock and lock handle 18 of the lock assembly 14 on the shipping container 10. As will be explained in greater detail below, while the first slot 120 and the second slot 122 are in communication with the interior chamber 116, the first slot 120 and the second slot 122 are dimensioned such that access from a person or a tool of intrusion into the interior chamber to manipulate the projection arm 104 and/or padlock 32 is minimized or prevented. Such dimensioning includes the first send segment **122*b* and the second end segment 122*c* that accommodate the lock handle 18 but prevent such access into the interior chamber 116. The front wall 106 defines a generally horizontal edge 125 proximate a top portion of the second slot 122. The horizontal edge 125** confronts the shipping container as will be described in greater detail below.

As further shown in FIGS. 4-6, the first side wall 110 and the second side wall 112 are generally planar structures. The first end segment **122*b* of the second slot 122 extends into a portion of the first sidewall 110 proximate the front wall 106, and generally between the top wall 114 and the bottom opening 118. Similarly, the second end segment 122*c* extends into a portion of the second sidewall 112 proximate the front wall 106, and generally between the top wall 114 and the bottom opening 118. As discussed, the respective first end segment 122*b* and the second end segment 122*c* of the second slot 122 define the lip 124. The lip 124 generally extends in a vertical direction and is positioned more proximate to the front wall 106 of the cover assembly 100. The lip 124 is dimensioned to accommodate the lock handle 18 and also to have a robust structure to engage the lock handle 18 as described below. The lip 124 defined can vary such as depending on the lock handle 18 structure and the desired engagement against the lock handle 18**.

The top wall 114 is connected to the front wall 106, the rear wall 108 and the first and second sidewalls 110, 112. The top wall 114 is a planar, uninterrupted structure that is void of any holes or openings thus closing off access into the interior chamber 116 from the top portion of the housing 102. The rear wall 108 is also a planar, uninterrupted structure that is void of any holes or openings thus closing off access into the interior chamber 116 from the rear portion of the housing 102. Thus, one cannot gain access to the projection arm 104 or padlock 32 or clasp assembly 22 from the top wall 114 or the rear wall 108. Access is completely blocked because of the solid uninterrupted structure of the top wall 114 and the rear wall 108. The rear wall 108 may have a handle 130 mounted thereon to assist in maneuvering the cover assembly 10.

As further shown in FIGS. 3-9, the cover assembly 10 further has a projection arm 104 having a proximal end that is connected to an inner surface of one of the walls of the cover housing 102 and extends into the housing 102. The projection arm 104 extends into the interior chamber 116 and is fully contained within the interior chamber 116 in an exemplary embodiment. The projection arm 104 is a planar bar member having an aperture 132 between the proximal end connected to the first side wall 110 and a distal end of the projection arm 104. In one exemplary embodiment, the projection arm 104 extends from the first side wall 110 at a position above the second slot 122 and into the interior chamber 116. The aperture 132 is positioned on the projection arm 104 such that aperture 132 is generally aligned with the first slot 120. As further shown in FIGS. 4-6, the projection arm 104 is mounted in a slight upwards angle towards the front wall 106. Thus, a portion of the projection arm 104 closest to the front wall 114 is positioned closer to the top wall 114 than a portion of the projection arm 104 closest to the rear wall 108. This configuration assists in the overall accommodation and cooperation with the clasp assembly 22 and padlock 32.

It is understood that the housing 102 can be formed by connecting the individual walls at various locations. In one exemplary embodiment, the cover assembly 100 is made from a metal material and the front wall 106 and the first and second side walls 110, 112 are integrally formed. The rear wall 108 and top wall 114 are then connected to the front wall 106 and the first and second side walls 110, 112. In one exemplary embodiment, the connections are formed via a welding operation. Other connection processes could also be utilized. In a particular exemplary embodiment, the front wall 106, rear wall 108 and first and second side walls 110, 112 are integral with one another, while the top wall 114 is welded to the respective top portions of the front wall 106, rear wall 108 and first and second side walls 110, 112. The bottom opening 118 is formed by the respective bottom portions of the front wall 106, rear wall 108 and the first and second side walls 110, 112. The cover assembly 100 can be formed from a variety of different materials. The materials can include but are not limited to metal materials, metal alloy materials, fiber reinforced plastic materials, ceramic materials or composite materials.

Figure 12:
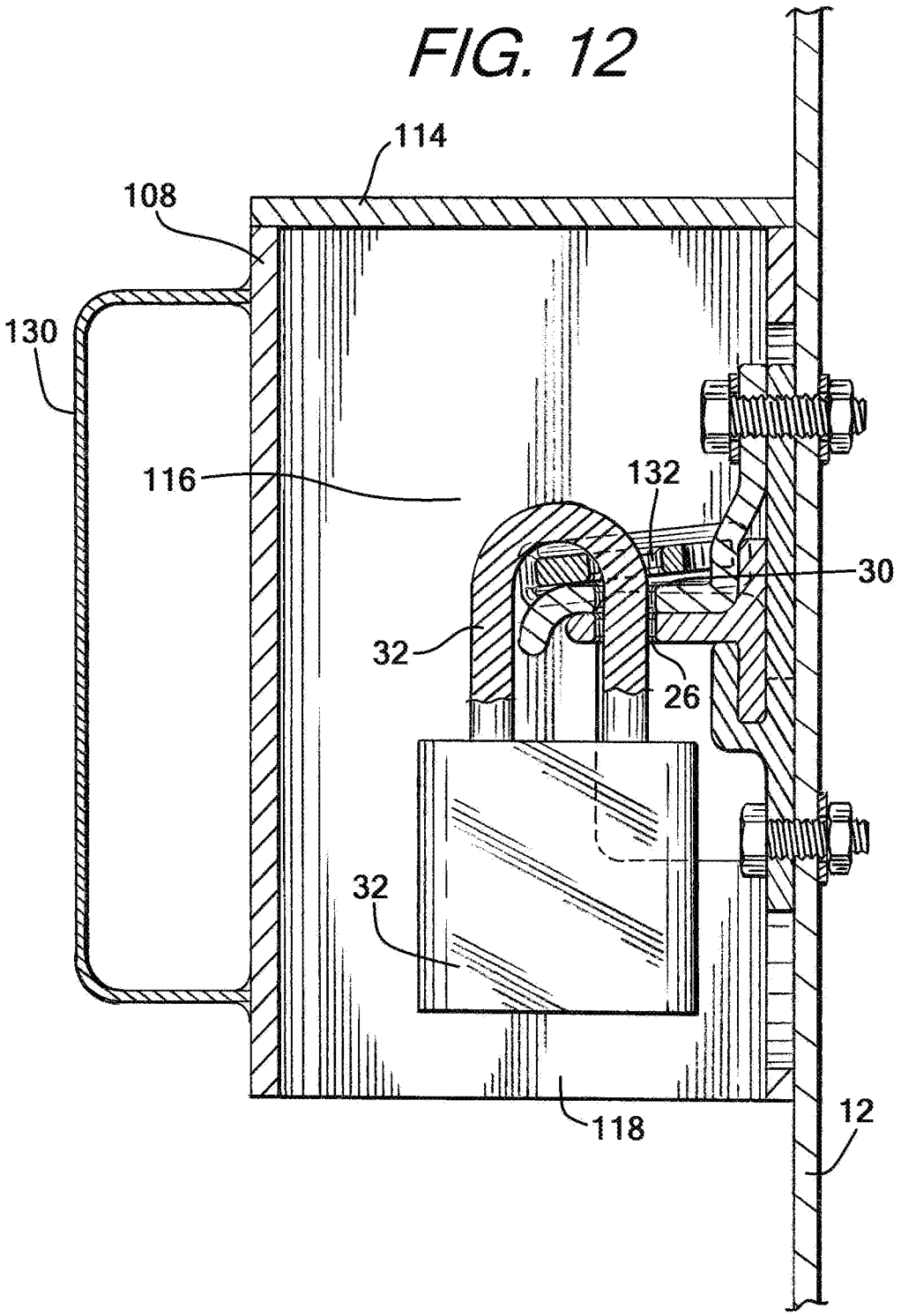
FIG. 12 is a cross-sectional view of the cover assembly taken along line 12-12 of FIG. 11 wherein the lock assembly is in a locked configuration and providing a tamper resistant configuration.
Figure 13:
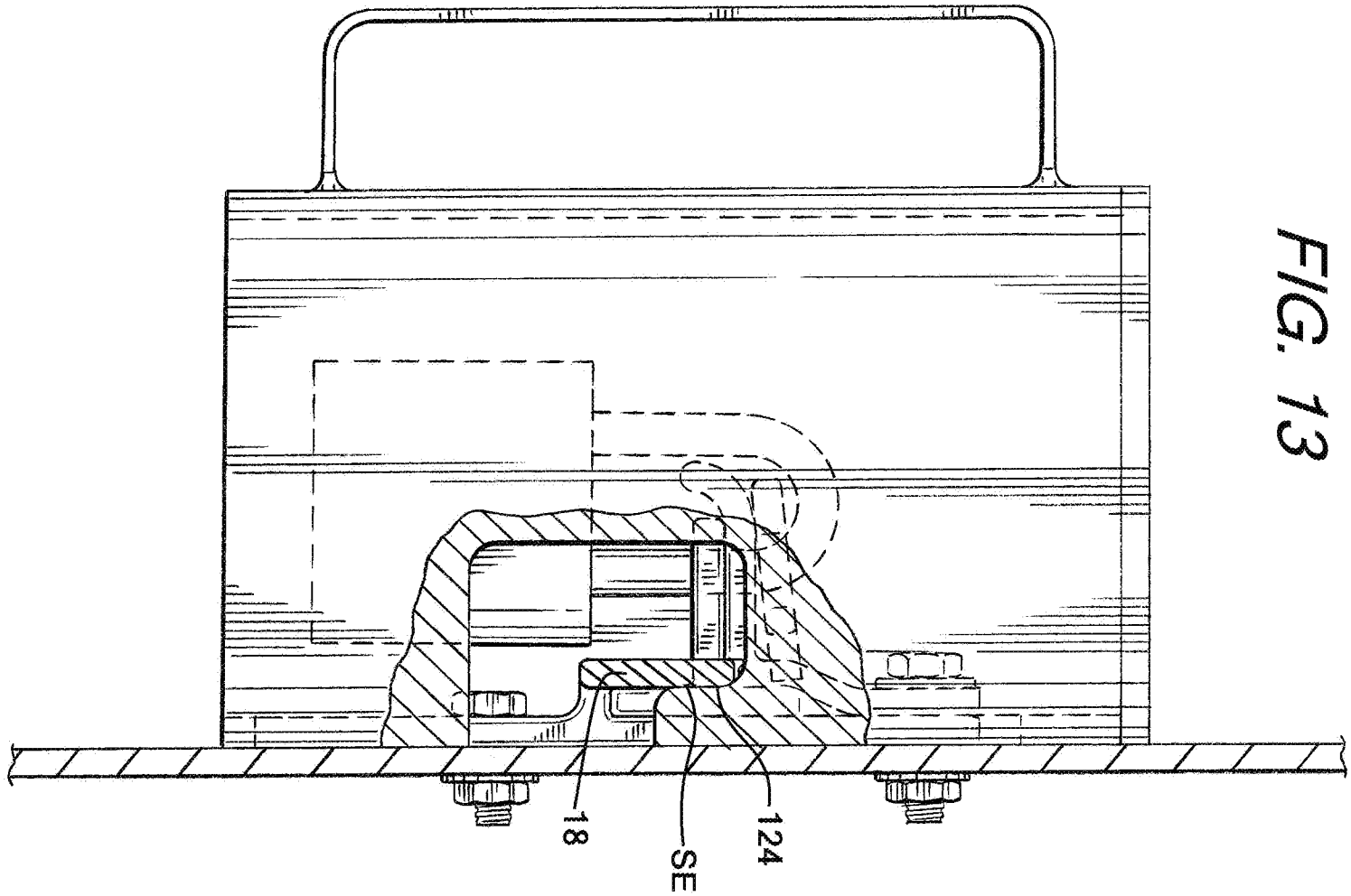
FIG. 13 is a side elevation view of the cover assembly with a portion shown in cross-section wherein a portion of the lock assembly is engaged by a portion of the side wall defining a lip.
Figure 14:
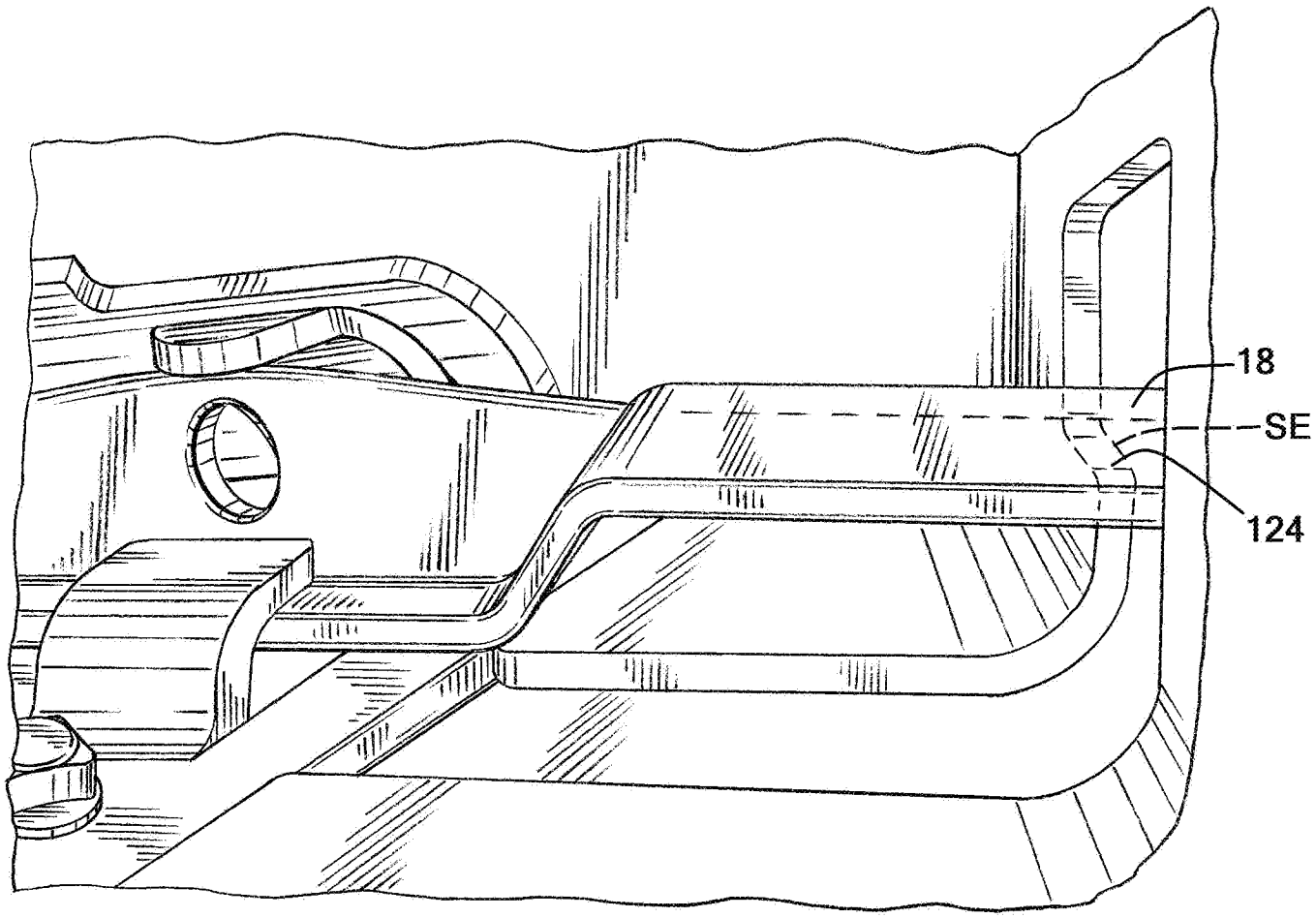
FIG. 14 is a partial underside view into the cover assembly showing the portion of the lock assembly engaged by a portion of the side wall defining the lip.

The cover assembly 100 is used when securing and locking a shipping container 10. As is known, the door 12 of the container 10 is placed in a shut configuration or closed configuration and the lock handle 18 of the lock assembly 14 and lock bolt 16 are positioned in a locked configuration wherein the lock bolt 16 cooperates with the keeper 20. The first and second clasp members 24, 28 and their respective openings 26, 30 are aligned to receive a traditional padlock 32. The padlock 32 is not yet attached through the clasp members 24, 26. As can be appreciated from FIGS. 1-2 and 10-13, the cover assembly 100 is positioned over the lock handle 18 wherein the clasp members 24, 26 are fit through the first slot 120 and lock handle 18 fit through the second slot 122, including the first end segment 122*b* and the second end segment 122*c*. The cover assembly 100 is lowered slightly such that horizontal edge 125 of the second slot 122 confronts the shipping container and the lip 124 engages the lock handle 18. As can be appreciated from FIGS. 11 and 13-14, the lock handle 18 extends through the first end segment 122*b* and the second end segment 122*c* of the second slot 122 wherein the lip 124 engages against the lock handle 18. For example, FIG. 13 shows a surface-to-surface engagement between the lip 124 and the lock handle 18 and designated SE. FIG. 14 shows an underside view where this engagement is further shown. This engagement assists in providing a snug, tight and secure fit of the cover assembly 10 over the lock assembly 14 of the shipping container 10. It is understood that the lock handle 18 could have alternative structures such as an aperture, but the lip 124 engages the lock handle 18 when the cover assembly 100 is mounted on the shipping container 10. It is understood that the first slot 120 and the second slot 122 are open in the front wall 106 and first side wall 110 and the second side wall 112. Accordingly, the cover assembly 100 can be easily mounted onto the lock assembly 14 from a front of the door 12 of the shipping container 10, wherein the lock handle 18 is easily accommodated. The lock handle 18 is not required to be fed through slots positioned in a central portion of the respective side walls. This provides a more efficient mounting method.

Figure 10:
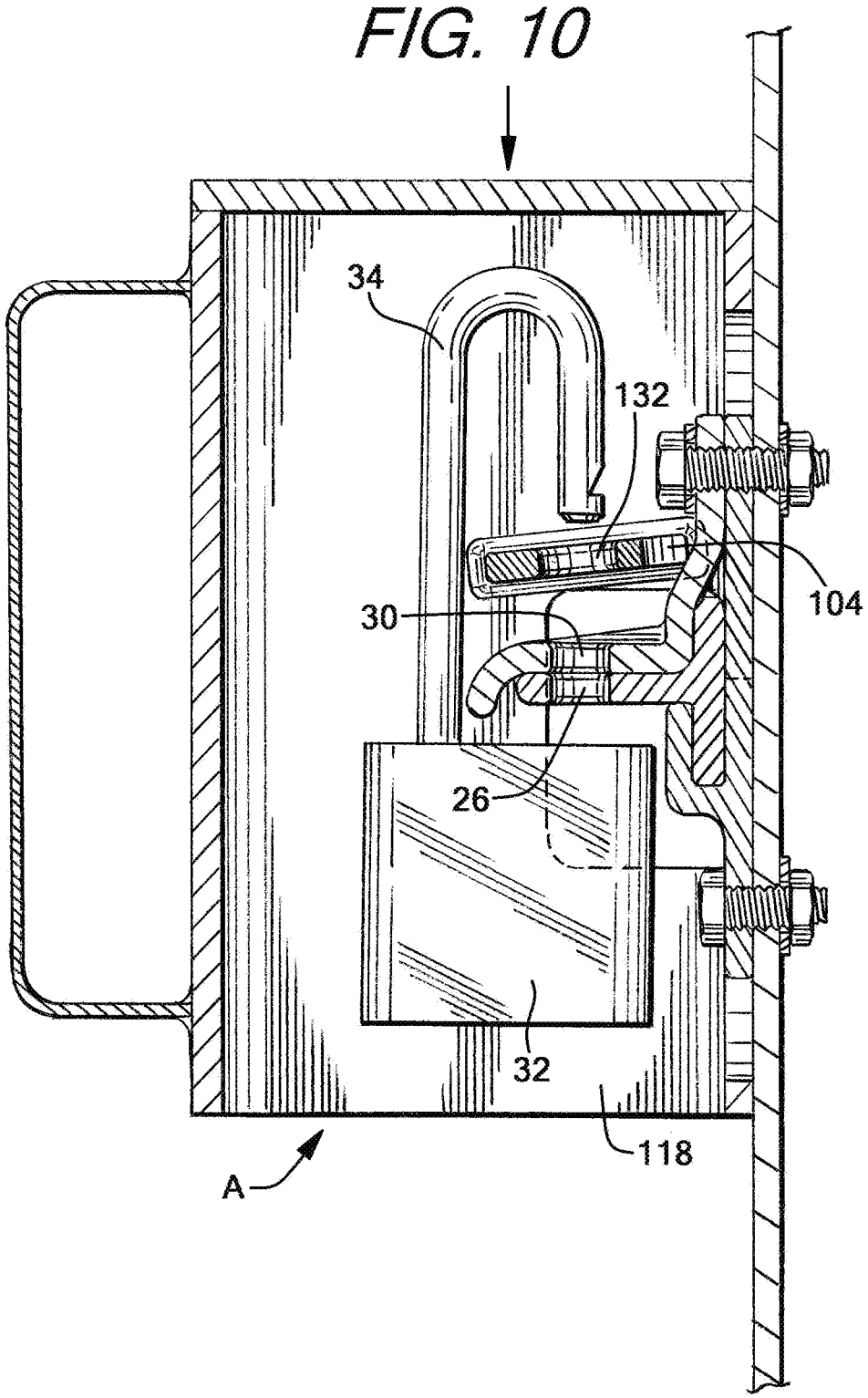
FIG. 10 is a side elevation view of the cover assembly mounted on the shipping container and having a side wall removed and showing a padlock to be installed on the lock assembly of the shipping container.
Figure 11:
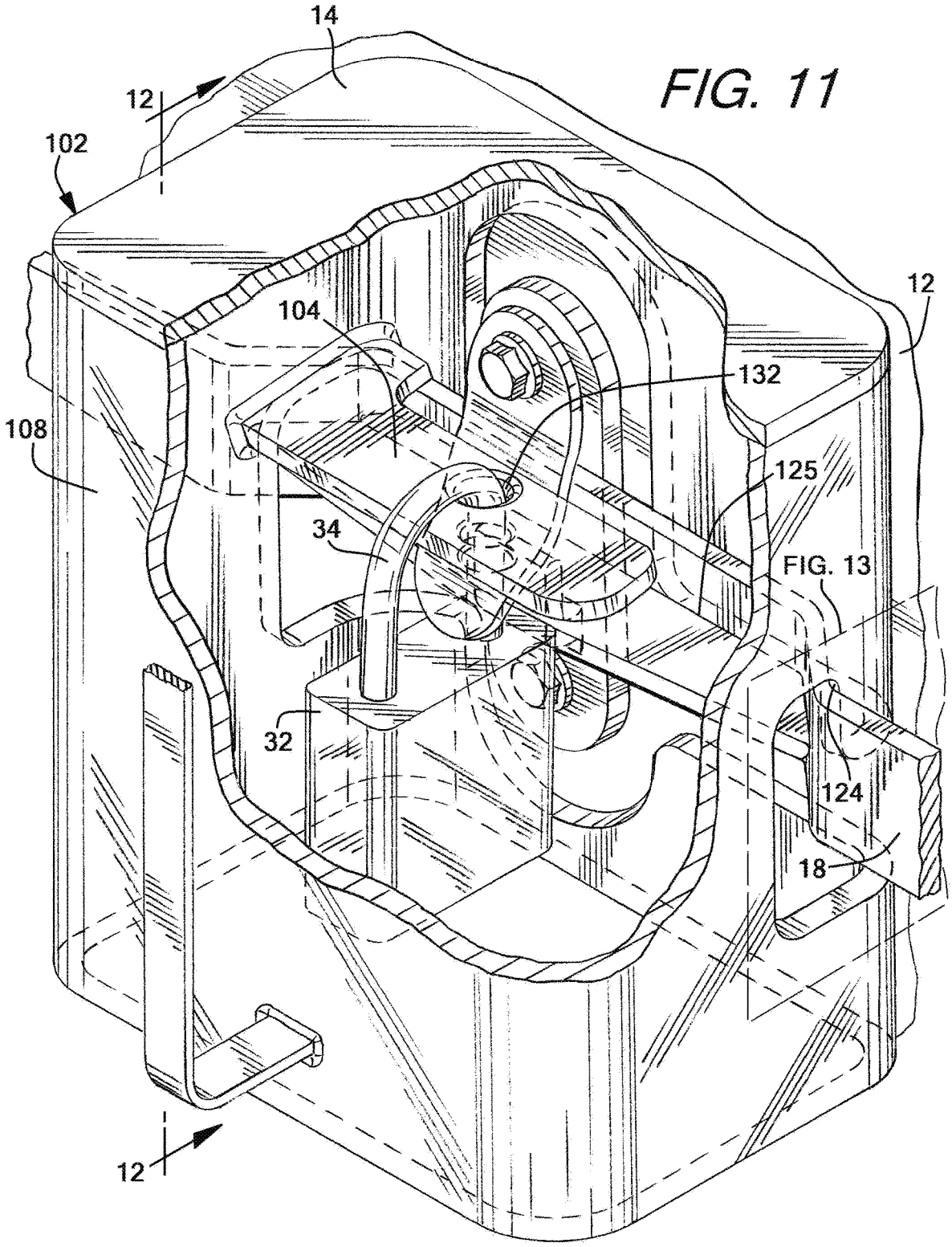
FIG. 11 is a rear perspective view of the cover assembly mounted on the shipping container with a portion of the top wall and rear wall broken away to show the padlock is inserted through a projection arm and clasp members of the lock assembly to place the lock assembly in a locked configuration and providing a tamper resistant configuration.

In this configuration, the aperture 132 on the projection arm 104 is generally aligned with the first clasp opening 26 and the second clasp opening 30 as shown in FIG. 10. The padlock 32 is inserted through the bottom opening 118 in the cover assembly 10 as schematically represented by the arrow A in FIG. 10, wherein the shackle 34 of the padlock 32 is fed through the clasp member openings 26, 30 and the aperture 132 on the projection arm 104, and the padlock 32 is placed in the locked configuration as shown in FIGS. 11-12. It is understood that the bottom opening 118 provides enough access for an operator/user to insert the padlock 32 and install as shown. In such configuration, it is understood that the cover assembly 100 cannot be removed from the shipping container 10 because the padlock 32 is also inserted through the projection arm 104 and clasp member openings 26, 30 that are integrally connected to the shipping container 10.

In this configuration, the cover assembly 100 provides a tamper resistant configuration. One cannot gain general access to the padlock 32 with the general exception of an operator having a key to unlock the padlock 32 through the bottom opening 118. The top wall 114 and rear wall 108 are solid walls without any openings preventing any access into the interior chamber and padlock 32 through such walls. The front wall 106 is substantially flush with the door 12 of the container 10. The second slot 122 in the side walls 110, 112 (end segments 122*b*, 122*c*) are dimensioned in size to just accommodate generally the lock handle 18 of the lock assembly 14. Would-be intruders, thieves or bad actors cannot use bolt cutters, hack saws or other intrusive tools to gain access into the interior chamber 116 to cut or break the lock 32 or otherwise manipulate/cut etc. the projection arm 104. The cover assembly 100 protects the lock 32 from being manipulated by such tools. Even the bottom opening 118 does not provide access to the shackle 34 of the lock 32 which is where the lock 32 must be compromised by the bad actors.

To unlock the padlock 32, a user can insert the key into the lock 32 through the bottom opening 118 of the cover assembly 10. The padlock 32 can be removed from the clasp openings 26, 30 and the projection arm 104. The cover assembly 100 is then free to be removed from the shipping container 10 wherein a user can gain access into the shipping container 10.

As discussed, the first end segment 122*b* and the second end segment 122*c* are defined by slot dimensions to accommodate the lock handle 18 therethrough while preventing access to the padlock 32 including access for tools of intrusion that could successfully compromise the integrity of the padlock 32. The general dimensions can be appreciated from FIGS. 4 and 5 and can be dimensioned as stated herein wherein the dimensions can also be varied to accommodate variations in lock assemblies 14 of other shipping containers 10 or other types of lock assemblies. As shown in FIG. 4, a width W1 of the first end segment 122*b* may be at or approximately 1.375 inches or in the range of 1.2 to 1.5 inches. A height H1 may be at or approximately 2.125 inches or in the range of 2.0 to 2.25 inches. The height of the lip 124 LH1 may be at or approximately 0.875 inches or in the range of 0.75 to 1.0 inches. The dimension D1 may be at or approximately 0.25 inches or in the range of 0.2 to 0.3 inches. Similarly, as shown in FIG. 5, a width W2 of the second end segment 122*c* may at or approximately 2.0 inches or in the range of 1.8 to 2.2 inches. A height H2 may be at or approximately 2.125 inches or in the range of 2.0 to 2.25 inches. The height of the lip 124 LH2 may be at or approximately 0.875 inches or in the range of 0.75 to 1.0 inches. The dimension D2 may be at or approximately 1.0 inches or in the range of 0.8 to 1.2 inches. It is understood that the first slot 120 is dimensioned in height and width to receive the lock assembly 14. Similarly, the second slot 122 is dimensioned to extend entirely across the front wall 106 and into the side walls 110, 112 and having a height to receive the lock assembly 14 therethrough. In one exemplary embodiment, and as shown in FIG. 6, the first slot 120 may have a height H3 of approximately 5.75 inches or in the range of 5.5-6.0 inches and a width W3 of approximately 2.1875 inches or in the range of 2-2.4 inches. The second slot 122 may have a height H4 of approximately 1.375 inches or in the range of 1.2-1.5 inches.

In a further exemplary embodiment, the cover assembly 100 may be formed from metal materials such as stainless steel having wall thicknesses of ¼ inch or 3/16 inch in certain embodiments. The wall thicknesses may be in the range of 0.125 inch to 0.3125 inch. It is understood that other thicknesses could be used as well as other materials having suitable strength to provide a tamper resistant configuration. In configurations where the cover assembly 100 is made of metal materials, certain walls may be integrally formed with one another while certain walls may be connected together via various connection methods including welding.

The cover assembly of the present invention provides several benefits. The cover assembly minimizes the ability of bad actors to successfully tamper with the padlock on the shipping container. The cover assembly fits securely over the lock assembly of the shipping container preventing open and ready access to the padlock. The top wall and rear wall are solid structures having no openings wherein the padlock is protected. The slots in the front wall and side walls are dimensioned to accommodate the lock assembly but not allow space for burglar tools to be inserted to tamper with the lock. The cover assembly 10 is also portable and can be used with any number of shipping containers. The cover assembly is not required to be a permanent fixture of the shipping container, which would be less desirable. The cover assembly can be removed and reattached as desired when necessary. Again, one key feature of the cover assembly is that it is removably attached to the shipping container and does not have to be integrally connected to the shipping container to provide a tamper resistant feature to the lock of the shipping container. The design of the front wall and slots provide an enhanced mounting over the lock assembly wherein the lip defined by the slot can fit against and engage the lock handle of the lock assembly. The projection arm is structured and dimensioned to efficiently cooperate with the clasp assembly wherein the padlock can be easily inserted through the projection arm and clasp assembly. Without the cover assembly, it is understood that one would have easy access to the lock assembly including a padlock on the lock assembly. It is understood that the cover assembly is used on a lock assembly of a typical shipping container in one exemplary embodiment. It is also understood that the cover assembly could also be used on other types of lock assemblies to provide a tamper resistant configuration.

While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. A tamper resistant cover assembly for a lock assembly operably connected to a shipping container, the lock assembly having a closed configuration when a door of the shipping container is in a shut configuration, the tamper resistant cover assembly comprising:

a cover housing defining an interior chamber and a bottom opening in communication with the interior chamber, a slot defined in the housing and being in communication with the interior chamber, the slot dimensioned to be configured to receive the lock assembly of the shipping container, a projection arm having a proximal end and distal end generally opposite the proximal end, the proximal end connected to an inner surface of the cover housing wherein the projection arm extends into the interior chamber, the projection arm having an aperture therein, wherein the distal end defines a free end of the projection arm, the distal end spaced from the inner surface of the cover housing, wherein when the lock assembly of the shipping container is in the closed configuration, the cover assembly is configured to be positioned on the shipping container wherein the slot is configured to receive the lock assembly, wherein the projection arm is positioned proximate the lock assembly wherein the aperture is generally aligned with openings in the lock assembly, wherein the bottom opening is configured to receive a padlock wherein a shackle of the padlock is inserted through the projection arm aperture, the shackle configured to be inserted into the openings of the lock assembly wherein the padlock is configured to be locked to place the lock assembly in a locked configuration, wherein the cover assembly is configured to provide a tamper-resistant configuration.

2. A cover assembly according to claim 1 wherein the cover housing has a front wall and a rear wall connected together by a first side wall and a second side wall, the housing further having a top wall connected to the front wall, rear wall, first side wall and second side wall to cooperatively define the interior chamber.

3. The cover assembly of claim 2 wherein the projection arm extends from one of the first sidewall and the second side wall.

4. The cover assembly of claim 3 wherein the projection arm is positioned between the front wall and the rear wall, and wherein the projection arm slopes downwardly from the front wall to the rear wall.

5. The cover assembly of claim 2 wherein the slot comprises a first slot defined in the front wall and being in communication with the interior chamber, the first slot having a generally vertical configuration, and a second slot defined in the front wall and in a portion of the first sidewall and in a portion of the second sidewall, the second slot being in communication with the interior chamber, the second slot having a generally horizontal configuration and intersects the first slot.

6. The cover assembly of claim 5 wherein a portion of one of the first side wall and the second side wall proximate the second slot defines a lip, wherein when the cover assembly is positioned on the shipping container wherein the lock assembly is received by the first slot and the second slot, the lip is configured to engage a lock handle of the lock assembly.

7. The cover assembly of claim 5 wherein the first slot extends in a longitudinal direction between the top wall and the bottom opening and a lateral direction between the first sidewall and the second sidewall, the first slot having a greater dimension in the longitudinal direction than a dimension in the lateral direction.

8. The cover assembly of claim 7 wherein the first slot has a rounded top end and a rounded bottom end.

9. The cover assembly of claim 5 wherein the second slot has a central segment and a first end segment and a second end segment wherein the central segment extends across the entire front wall and the first end segment extends into a portion of the first sidewall and the second end segment extends into a portion of the second sidewall.

10. The cover assembly of claim 2 wherein the top wall and the rear wall are solid, uninterrupted structures having no openings.

11. The cover assembly of claim 2 wherein the front wall, the first side wall and the second side wall are formed from an integral structure.

12. The cover assembly of claim 1 wherein the cover assembly is formed from a metal material.

13. The cover assembly of claim 1 wherein the cover assembly is formed from one of a metal material, metal alloy material, fiber reinforced plastic material, ceramic material or composite material.

14. The cover assembly of claim 2 further comprising a handle connected to a rear wall of the cover housing.

15. The cover assembly of claim 1 wherein the cover housing has a front wall, a rear wall, a first side wall and a second side wall integrally formed with one another.

16. The cover assembly of claim 15 wherein the cover housing further has a top wall connected to respective top portions of the front wall, the rear wall, the first side wall and the second side wall.

17. The cover assembly of claim 1 wherein the cover housing is stainless steel having one of a thickness of 0.1875 inch and 0.25 inch.

18. A tamper-resistant cover assembly for a lock assembly operably connected to a shipping container, the lock assembly having a lock bolt operably connected to a lock handle that places a door of the shipping container in a shut configuration, the lock assembly further having a first clasp member having a first clasp opening and a second clasp member having a second clasp opening, the lock handle being operably associated with the clasp members in a closed configuration of the lock assembly, the cover assembly comprising:

a cover housing having a front wall and a rear wall connected together by a first side wall and a second side wall, the housing further having a top wall connected to the front wall, rear wall, first side wall and second side wall to cooperatively define an interior chamber, the housing further having a bottom opening in communication with the interior chamber, a first slot defined in the front wall and being in communication with the interior chamber, the first slot having a generally vertical configuration, and a second slot defined in the front wall and in a portion of the first sidewall and in a portion of the second sidewall, the second slot being in communication with the interior chamber, the second slot having a generally horizontal configuration and intersects the first slot, a projection arm having a proximal end and a distal end, the proximal end connected to one of the first side wall and the second side wall, the projection arm extending into the interior chamber and positioned between the front wall and the rear wall, the projection arm having an aperture proximate the distal end, wherein when the lock assembly of the shipping container is in the closed configuration, the cover assembly is positioned over the lock assembly wherein the first slot and the second slot are configured to receive the clasp members and the lock handle, wherein the projection arm is positioned proximate the clasp members wherein the aperture is generally aligned with the first clasp opening and the second clasp opening, wherein the bottom opening is configured to receive a padlock wherein a shackle of the padlock is configured to be inserted through the projection arm aperture, the shackle configured to be inserted into the first clasp opening and the second clasp opening wherein the padlock is configured to be locked to place the lock assembly in a locked configuration, wherein the cover assembly is configured to provide a tamper-resistant configuration.

19. A shipping container assembly comprising:

a shipping container defining a compartment for receiving goods to be stored and transported, the shipping container having a door having a closed configuration and an open configuration to allow access to the compartment, the shipping container further having a lock assembly, the lock assembly having a lock bolt moveably mounted on the door and having a lock handle connected to the lock bolt, the lock bolt having a distal end received in a keeper of the shipping container when the door is in the closed configuration, the lock bolt removed from the keeper to allow the door to be positioned in the open configuration, the lock assembly further having a first clasp member having a first clasp opening mounted on the door and a second clasp member having a second clasp opening mounted on the door, the lock handle being positionable between the clasp members;

a cover assembly comprising a cover housing having a front wall and a rear wall connected together by a first side wall and a second side wall, the housing further having a top wall connected to the front wall, rear wall, first side wall and second side wall to cooperatively define an interior chamber, the housing further having a bottom opening in communication with the interior chamber, and a first slot defined in the front wall and being in communication with the interior chamber, the first slot having a generally vertical configuration, and a second slot defined in the front wall and in a portion of the first sidewall and in a portion of the second sidewall, the second slot being in communication with the interior chamber, the second slot having a generally horizontal configuration and intersects the first slot;

a projection arm having a proximal end and a distal end, the proximal end connected to the first side wall, the projection arm extending into the interior chamber and positioned between the front wall and the rear wall, the projection arm having an aperture proximate the distal end; and a padlock having a shackle, the padlock having an unlocked configuration and a locked configuration, wherein when the door of the shipping container is in the closed configuration and the lock bolt of the lock assembly is received in the keeper of the shipping container and the lock handle is positioned between the first clasp member and the second clasp member, the cover assembly is positioned over the lock assembly wherein the first slot and the second slot are configured to receive the clasp members and the lock handle, wherein the projection arm is positioned proximate the clasp members wherein the aperture is generally aligned with the first clasp opening and the second clasp opening, wherein the bottom opening receives the padlock wherein the shackle of the padlock is inserted through the projection arm aperture, the first clasp opening and the second clasp opening wherein the padlock is placed in the locked configuration, wherein the cover assembly provides a tamper-resistant configuration.

20. A tamper resistant cover assembly for a lock assembly operably connected to a shipping container, the lock assembly having a closed configuration when a door of the shipping container is in a shut configuration, the tamper resistant cover assembly comprising:

a cover housing defining an interior chamber and a bottom opening in communication with the interior chamber, wherein the cover housing has a front wall and a rear wall connected together by a first side wall and a second side wall, the housing further having a top wall connected to the front wall, rear wall, first side wall and second side wall to cooperatively define the interior chamber, a slot defined in the housing and being in communication with the interior chamber, the slot dimensioned to be configured to receive the lock assembly of the shipping container, a projection arm having a proximal end and distal end, the proximal end connected to an inner surface of the cover housing wherein the projection arm extends from one of the first sidewall and the second side wall, wherein the projection arm is positioned between the front wall and the rear wall, and wherein the projection arm slopes downwardly from the front wall to the rear wall, wherein the projection arm extends into the interior chamber, the projection arm having an aperture therein, wherein when the lock assembly of the shipping container is in the closed configuration, the cover assembly is configured to be positioned on the shipping container wherein the slot is configured to receive the lock assembly, wherein the projection arm is positioned proximate the lock assembly wherein the aperture is generally aligned with openings in the lock assembly, wherein the bottom opening is configured to receive a padlock wherein a shackle of the padlock is inserted through the projection arm aperture, the shackle configured to be inserted into the openings of the lock assembly wherein the padlock is configured to be locked to place the lock assembly in a locked configuration, wherein the cover assembly is configured to provide a tamper-resistant configuration.

21. A tamper resistant cover assembly for a lock assembly operably connected to a shipping container, the lock assembly having a closed configuration when a door of the shipping container is in a shut configuration, the tamper resistant cover assembly comprising:

a cover housing defining an interior chamber and a bottom opening in communication with the interior chamber, wherein the cover housing has a front wall and a rear wall connected together by a first side wall and a second side wall, the housing further having a top wall connected to the front wall, rear wall, first side wall and second side wall to cooperatively define the interior chamber, a slot defined in the housing and being in communication with the interior chamber, the slot dimensioned to be configured to receive the lock assembly of the shipping container, wherein the slot comprises a first slot defined in the front wall and being in communication with the interior chamber, the first slot having a generally vertical configuration, and a second slot defined in the front wall and in a portion of the first sidewall and in a portion of the second sidewall, the second slot being in communication with the interior chamber, the second slot having a generally horizontal configuration and intersects the first slot, a projection arm having a proximal end and distal end, the proximal end connected to an inner surface of the cover housing wherein the projection arm extends into the interior chamber, the projection arm having an aperture therein, wherein when the lock assembly of the shipping container is in the closed configuration, the cover assembly is configured to be positioned on the shipping container wherein the slot is configured to receive the lock assembly, wherein the projection arm is positioned proximate the lock assembly wherein the aperture is generally aligned with openings in the lock assembly, wherein the bottom opening is configured to receive a padlock wherein a shackle of the padlock is inserted through the projection arm aperture, the shackle configured to be inserted into the openings of the lock assembly wherein the padlock is configured to be locked to place the lock assembly in a locked configuration, wherein the cover assembly is configured to provide a tamper-resistant configuration.

* * * * *